United States Patent [19]

Keith

[11] 4,107,859

[45] Aug. 22, 1978

[54] DEPTH INDICATING AND DEPTH CONTROLLING DEVICES FOR EARTH MOVING MACHINES

[76] Inventor: Wayland D. Keith, P.O. Box 2446, Wichita Falls, Tex. 76307

[21] Appl. No.: 644,165

[22] Filed: Dec. 24, 1975

Related U.S. Application Data

[63] Continuation of Ser. No. 560,260, Mar. 20, 1975, abandoned, which is a continuation of Ser. No. 457,658, Apr. 4, 1974, abandoned, which is a continuation of Ser. No. 364,331, May 29, 1973, abandoned, which is a continuation of Ser. No. 256,618, May 24, 1972, abandoned, which is a continuation of Ser. No. 59,371, Jul. 29, 1970, abandoned, which is a continuation-in-part of Ser. No. 813,778, Jun. 26, 1969, abandoned, which is a continuation-in-part of Ser. No. 504,380, Oct. 24, 1965, abandoned.

[51] Int. Cl.[2] ..... E02F 3/62

[52] U.S. Cl. ..... 37/126 A; 37/DIG. 1; 37/DIG. 19; 37/DIG. 20; 172/4

[58] Field of Search ..... 37/126, 129, DIG. 19, 37/DIG. 20, 124 AC, 5 AL, DIG. 1; 340/181; 172/4, 430

[56] References Cited

U.S. PATENT DOCUMENTS

| | | | |
|---|---|---|---|
| 2,851,799 | 9/1958 | Meents et al. | 340/280 X |
| 2,894,253 | 7/1959 | Peaslee et al. | 340/198 |
| 3,052,997 | 7/1961 | Holland | 37/DIG. 19 |
| 3,233,349 | 2/1966 | Becton | 37/124 |

*Primary Examiner*—Clifford D. Crowder

[57] ABSTRACT

A depth indicator and automatic control device to indicate and control the position of an earth cutting blade, being drawn by a tractor, with respect to the surface of the terrain over which the tractor wheels of the prime mover pass, as it draws the blade through the ground. Provision is made to readily compensate the position of the cutting edge of the blade with respect to the normal surface of the ground over which the tractor wheels move, so as to enable the depth of the cut to be accurately determined and also enable the adjusting of the device remotely from the earth moving blade, and while the earth moving device is in operation. Provision is also made to enable the blade to be maintained a controlled distance above the ground for spreading material that is being discharged.

1 Claim, 25 Drawing Figures

254
252
12
11
10
9
8
7
6
5
4
3
2
1
0
1
2
3
4
5
6
7
8
9
242
256
236
234
232
228
230
201
202
204
280
278
206
14
16
264
258
253
242
261
260
238
240
262
266
267
276
274
268
272
270

318
340
15
334
326
15
342
324
320
16
318
316
314
308
306
17
348
346

342
330
340
338
334
326
322
312

320
328
336
332
324
312

301
308
306
302
280
304
278
14
17
206
16
342
348
346
344

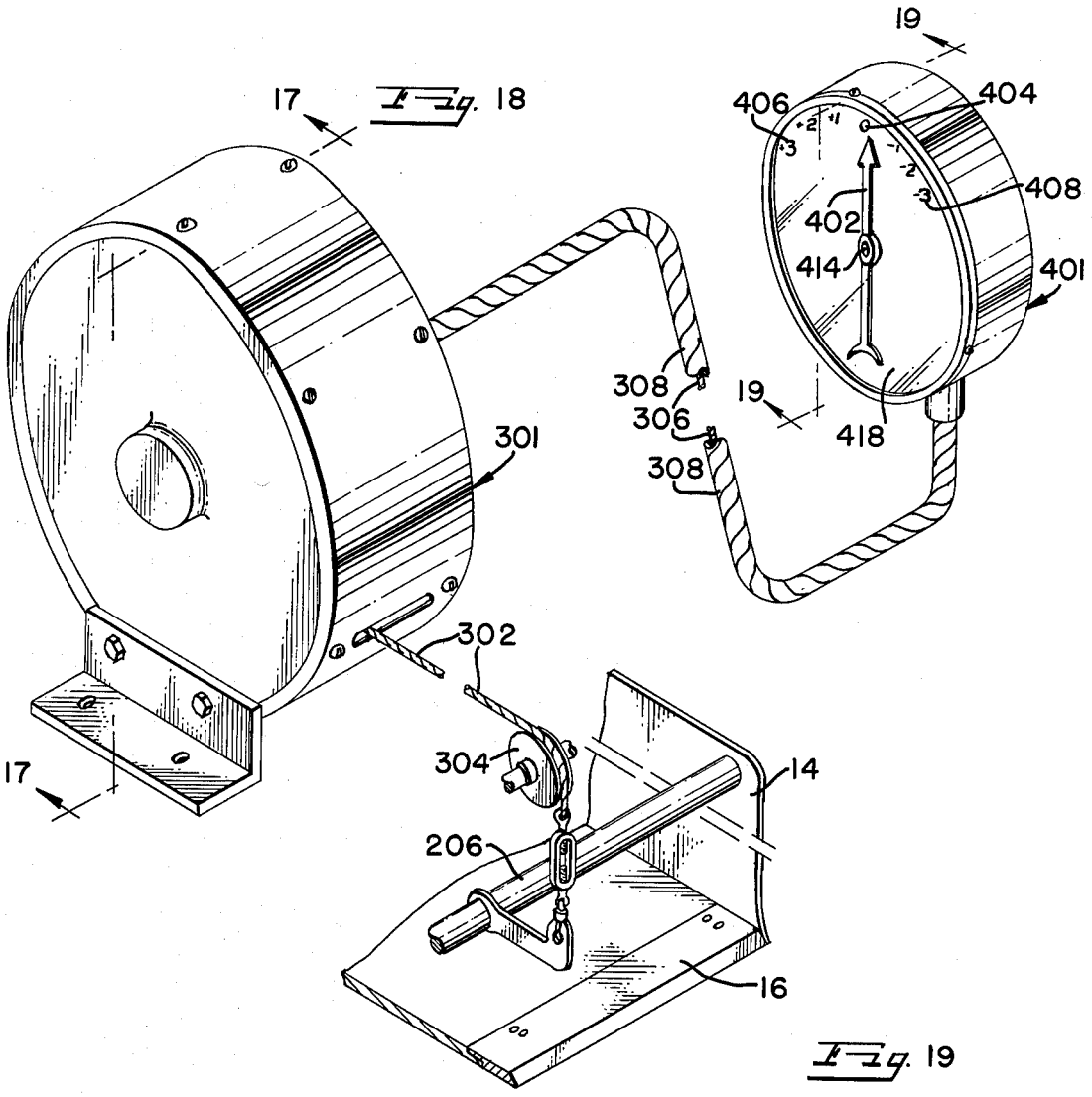
Fig. 19
Fig. 17
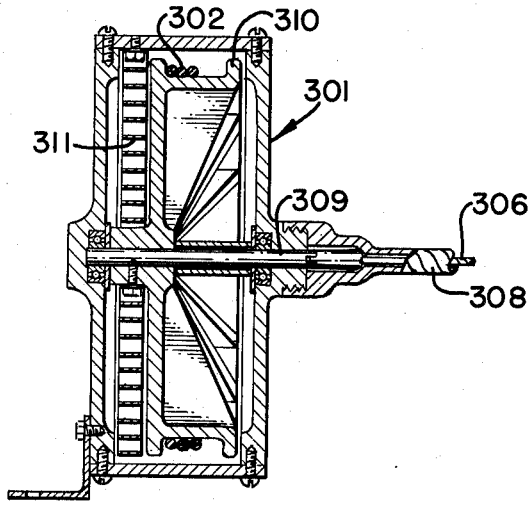
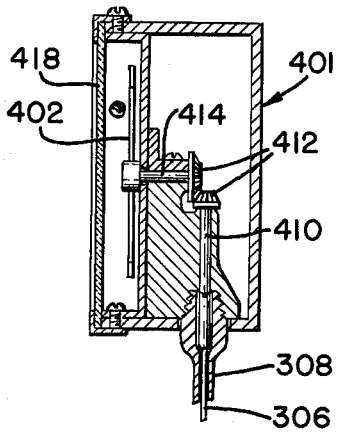

501
506
507
502
504
510
206
14
16

524
522
516
520
518
532
534
514
528
530
526

520
524
514
526
512
508
516
524
526
514
528
534
532
530
1
2
3
4
5
6
7
8
9
10
11

DEPTH INDICATING AND DEPTH CONTROLLING DEVICES FOR EARTH MOVING MACHINES

This application is a continuation of application Ser. No. 560 260, filed Mar. 20, 1975 for DEPTH INDICATING AND DEPTH CONTROLLING DEVICES FOR EARTH MOVING MACHINES; which in turn is a continuation of application Ser. No. 457 658, filed Apr. 4, 1974, of the same title; application Ser. No. 457 658 was a continuation of application Ser. No. 364 331, filed May 29, 1973, of the same title; which was a continuation of application Ser. No. 256 618, filed May 24, 1972, of the same title; this application was a a continuation of application Ser. No. 59 371, filed July 29, 1970, of the same title; which application was a continuation-in-part of application Ser. No. 813 778, filed June 26, 1969, of the same title, which application was a continuation in part of application Ser. No. 504 380, of the same title, filed Oct. 24, 1965. Each of these applications was co-pending with the previous application, thereby giving a complete chain of dates from Oct. 24, 1965 to the present application Ser. No. 644 165, of the same title, which was filed Dec. 24, 1975, all now abandoned.

This invention relates to improvements in indicators and depth controls for earth moving equipment, and more particularly to controls and indicators which will enable an operator of an earth moving machine to accurately determine the exact depth below or above the level of the terrain at which the blade of the earth moving device is operating, and furthermore, to accurately and positively maintain the blade at a given position relative to the surface of the terrain on which the earth moving device is operating, so as to maintain the edge of the blade at a position to cut to the desired depth or to be spaced above the surface of the terrain to enable the spreading of earth to a uniform depth by action of the ejector plunger.

Earth moving devices heretofore required a highly skilled operator to observe the depth at which the blade engaged the ground with respect to the level of the terrain on which the earth moving device was operating and to observe the distance above the ground while unloading or filling dirt into low places. Even the most experienced operators frequently had difficulty in determining, with any degree of accuracy, these positions of the blade, especially on earth moving equipment of the high speed character, which is usually used for moving dirt over relatively long distances without loading it onto trailers or trucks.

An object of this invention is to provide an indicating and control device which will give an accurate indication as to the position of the cutting blade with respect to the terrain traversed by the traction wheels of the prime mover.

Another object of the invention is to provide an indicator device wherein a zero reading with respect to the surface of the terrain may be adjusted by the gauge wheel engaging the terrain, which gauge wheel actuates a fluid control system to vary the position of an earth engaging blade of the earth moving device while the earth moving device is in operation.

Still another object of the invention is to provide an automatic zero compensating device, with a gauge wheel engaging the terrain to automatically indicate the relative position of the cutting edge of the blade with respect to the terrain over a path traversed by the prime mover.

Yet a further object of the invention is to provide a hydraulically actuated control system for automatically controlling the depth of the cutting edge of the blade of the earth cutting machine, with respect to the terrain within specified limits.

Still another object of the invention is to provide an auxiliary hydraulic system which will actuate the indicating elements in coordinated relation with respect to the cutting edge of the blade of the earth moving device.

A further object of the invention is to provide a hydraulically actuated control system for an earth moving machine, which will maintain the blade thereof within certain limits with respect to the terrain.

With these objects in mind and others which will become manifest as the description proceeds, reference is to be had to the accompanying drawings in which like reference characters designate like parts in the several views thereof, in which:

FIG. 17 is a sectional view taken on the line 17—17 of FIGS. 13 and 18, looking in the direction indicated by the arrows;

FIG. 18 is a perspective view of a fourth form of the invention, with parts broken away, with parts shortened, and with parts shown in section to bring out the details of construction;

FIG. 19 is a sectional view taken on the line 19—19 of FIG. 18, looking in the direction indicated by the arrows;

Figure 10:
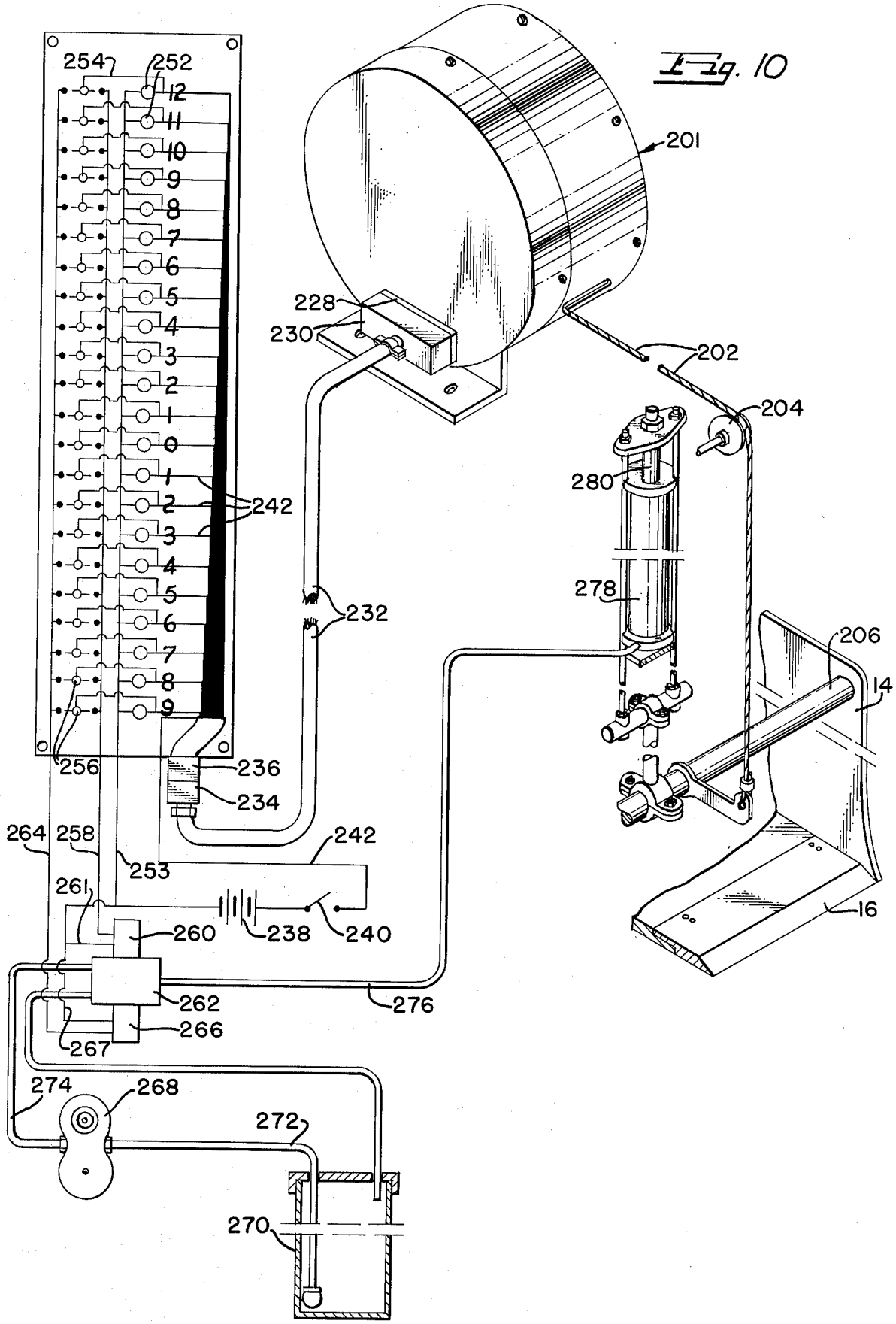
FIG. 10 shows a perspective view, which is partly in elevation and partly diagrammatic, of a second form of the invention.
Figure 12:
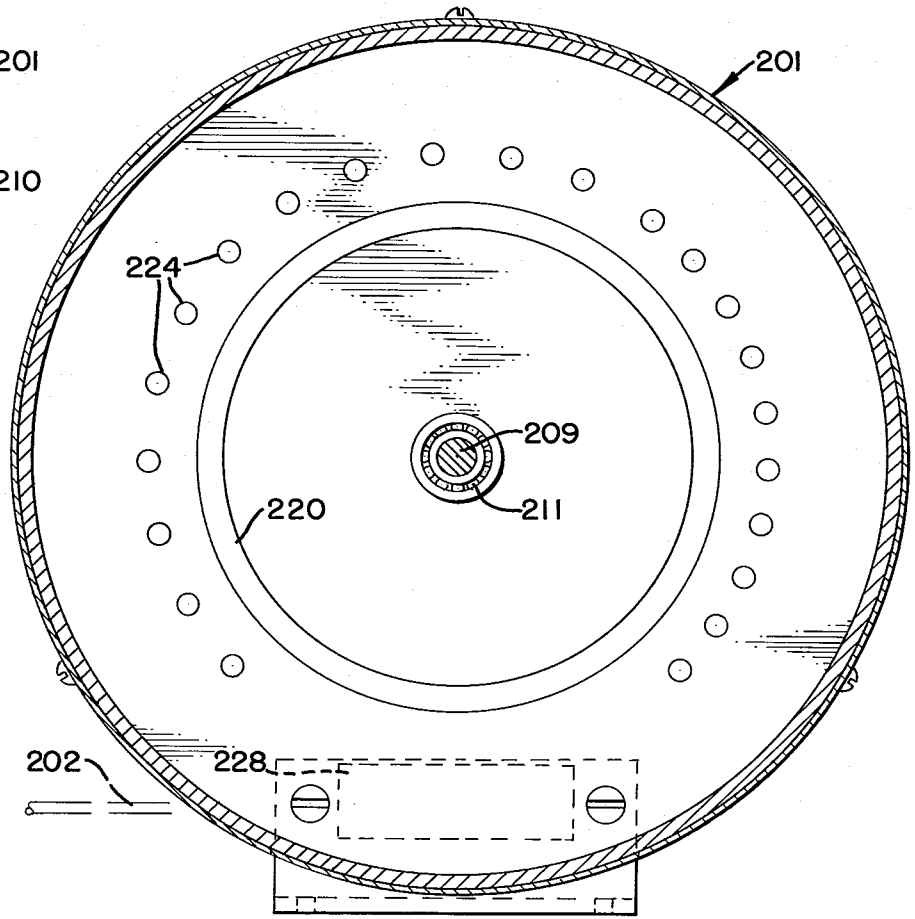
FIG. 12 is a sectional view taken on the line 12—12 of FIG. 11, looking in the direction indicating by the arrows.
Figures 20, 21, 22:
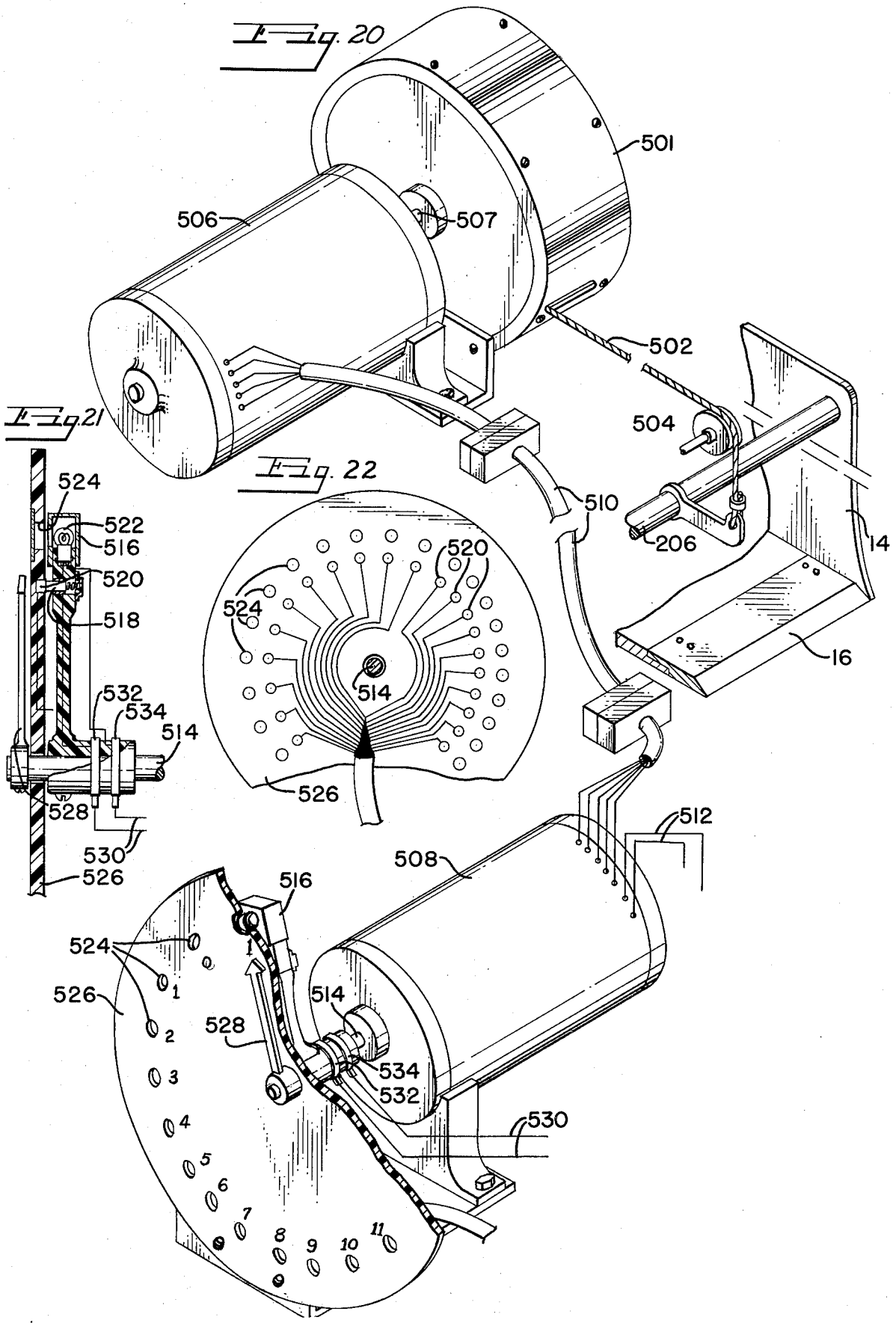
FIG. 20 is a perspective view of the scraper portion of an earth moving machine, showing a fifth form of the invention, with parts being broken away, and with parts being shown in section.
FIG. 21 is a vertical sectional view through the indicating element, with parts being shown in elevation.
Figure 23:
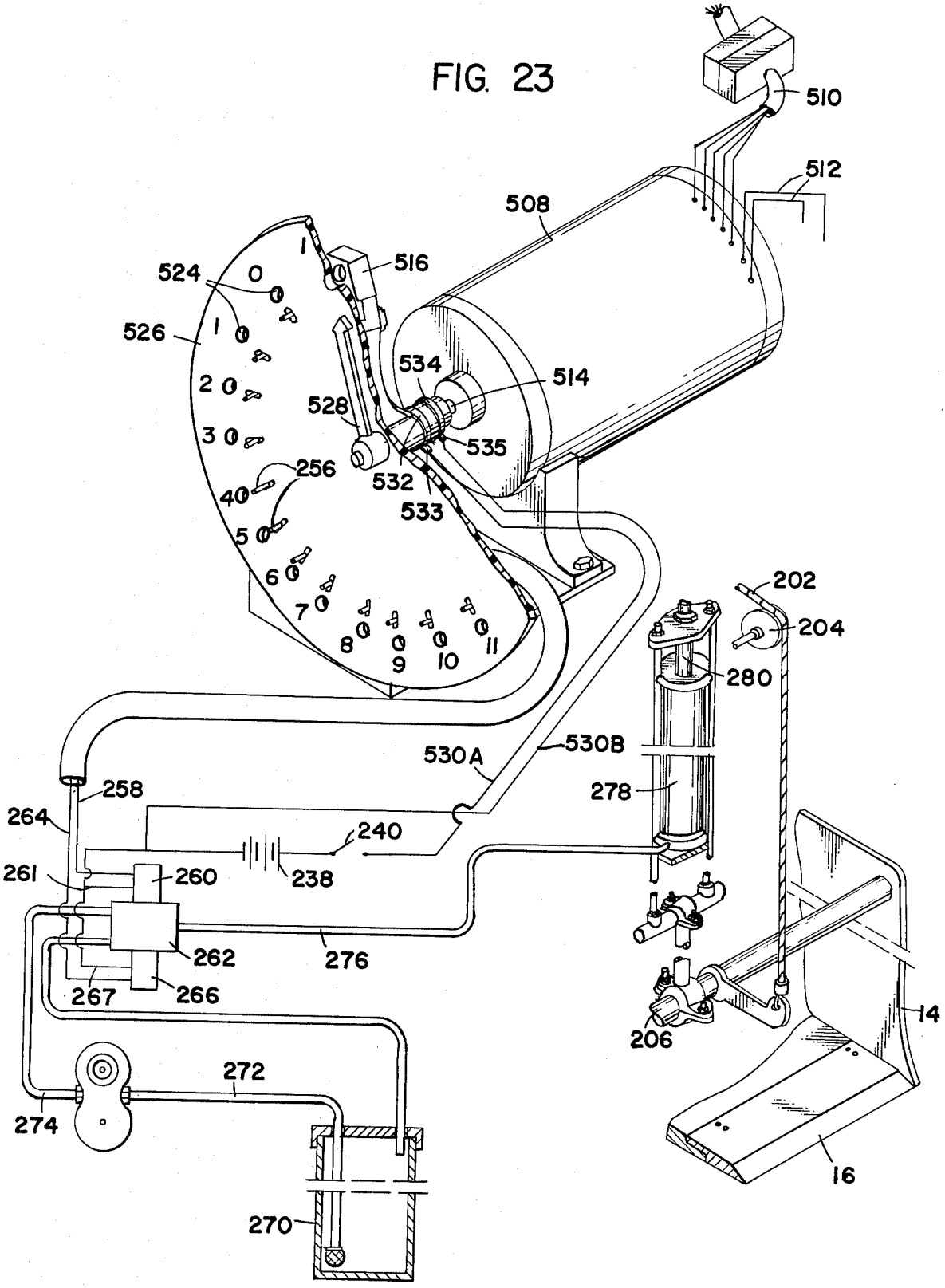

FIG. 22 is a vertical sectional view, showing the holes through which the light shines, also showing contacts and a portion of a cable which leads to automatic regulating switches such as shown in FIG. 10; and FIG. 23 is a fragmentary portion of the selsyn control system as shown in FIG. 22, and showing the contacts thereof connected with the electrical system of which is shown diagrammatically, which is associated with a solenoid valving arrangement to control the hydraulic system for automatically raising and lowering the earth cutting blade.

Figure 24:
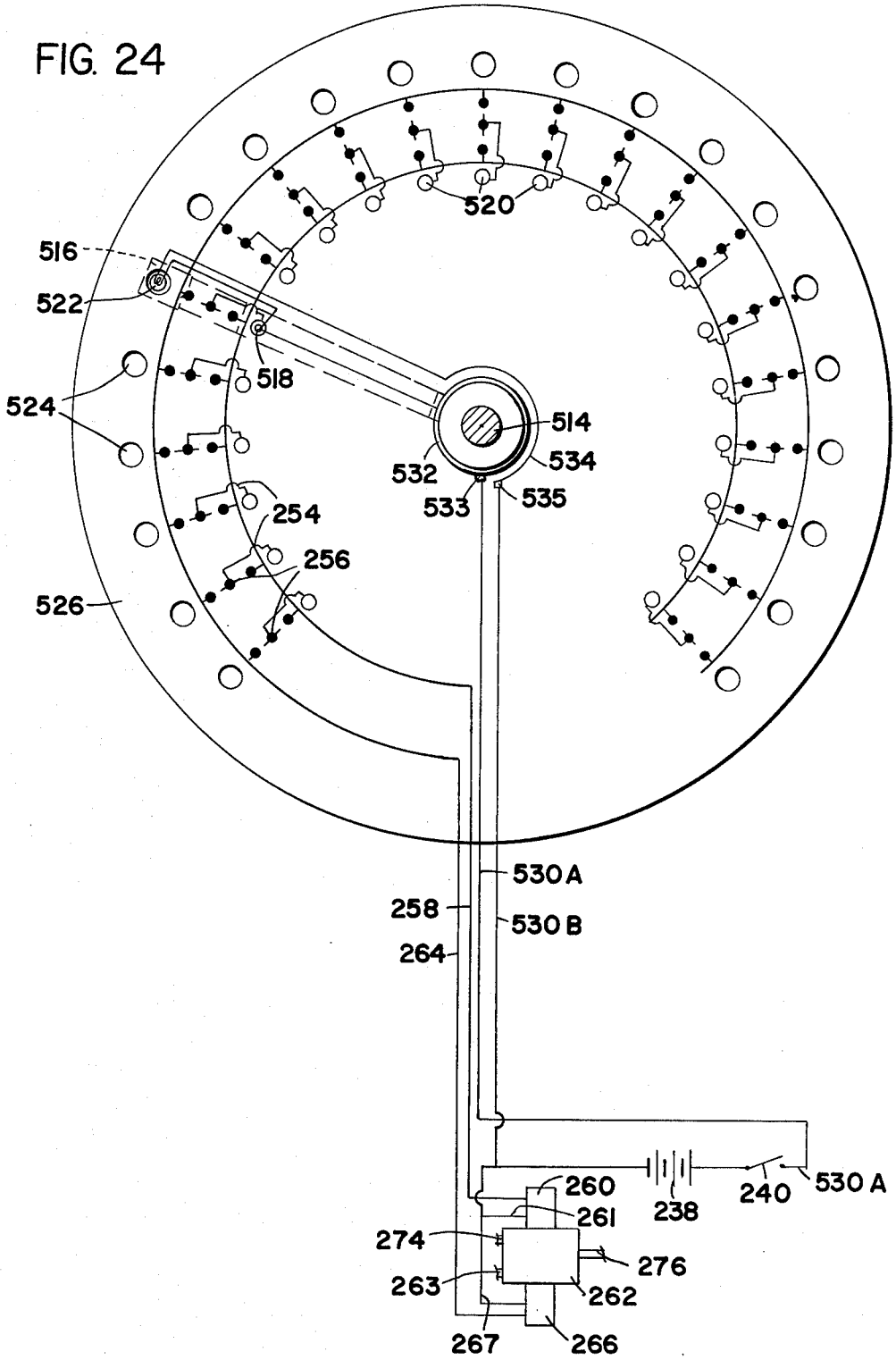

FIG. 24 is a diagrammatic view of the wiring and switching arrangement of the electrical system of the form of the invention, as shown in FIG. 23.

With more detailed reference to the drawing the numeral 1 designates a wheeled earth moving scraper, which is connected to a wheeled prime mover 2 in pivoted relation about an axis 4. Wheels 6, on each side of the scraper 1, have pneumatic tires thereon, and the prime mover or traction element 2 has wheels 8 on each side thereof, which wheels 8 have pneumatic tires thereon.

A goose-neck drawbar 10 permits a short turning radius of traction element 8, as the goose-neck 10 is rigid with respect to a horizontal axis, which goose-neck connects with rearwardly extending frame members 12, which members 12 are pivoted to the frame 14 of the scraper intermediate the length of scraper unit 1 so as to permit the raising and lowering of the frame 14 and blade 16 with respect to a horizontal plane upon which the wheels 6 and 8 rest. The raising and lowering of the scraper frame 14 and blade 16 is accomplished by action of a plunger 18, which is fitted in a cylinder 19 within a first hydraulic system, which cylinder is mounted on the goose-neck 10. The plunger 18 is pivotally connected to a walking beam type lever 20 intermediate the length of said walking beam. One end of the walking beam lever is pivoted, by a pin 22, to lugs on the upper face of goose-neck 10. The opposite end of the walking beam lever 20 has a pivot pin 24 passing therethrough and through an eye in the upper end of connecting rod 26 which extends between the outer end of walking beam 20 and the forward end of frame 14. The connecting rod 26 is pivoted to a transverse member 28, as will best be seen in FIG. 1.

The indicator and control device, which is the subject of the present application, is mounted on and operatively connected to the scraper 1 and traction element 2 in such manner that an operator, on the traction element, may have the operation of the device under observation at all times, and which device is so constructed that the operator can face forwardly at all times the earth moving equipment is in operation, and which indicators and controls will indicate to him the exact position of the cutting edge of the blade 16 at all times, and the controls may be set to maintain the cutting edge of the blade within given limits, thereby relieving the operator of great responsibility in maintaining the correct depth while cutting earth or filling earth onto the terrain.

The sensing element, for indicating the relative position of the cutting edge 16 of the scraper 1 when the device is used on a wheeled scraper, is a hydraulic cylinder 30 in which is mounted a plunger 32, which are included in a second hydraulic system, which plunger has the usual fluid tight seal or piston thereon. The upper end of the cylinder 30 is pivotally connected by a pin 34 to a bracket 36 which is secured in fixed relation to goose-neck 10. The lower end of the plunger 32 is pivotally connected by a pin 38 to a bracket 40, which bracket is movable with the edge of the scraper blade 16.

When the cylinder 30 is mounted directly above the cutting edge 16 of the scraper blade the movement of the plunger 32 will be in a one to one ratio. However, the movement of the plunger may be varied by the use of cables or the variation of movement of the plunger may be otherwise compensated for, if the plunger 32 is located forward or rearward of the cutting edge of the blade. It is preferable to have a conventional dust boot 42 extending between the lower end of cylinder 30 and the lower end of connecting rod 32 so as to prevent dust or other foreign matter from accumulating on plunger 32.

The upper end of the cylinder 30 has a fluid conduit 44 leading therefrom and to a tee 46, to which tee is connected a zero compensating cylinder 48, which cylinder has a plunger 50 therein, the lower end of which has a cup or piston 52 thereon. The plunger 50 is pivotally connected to an arm 54 intermediate the length thereof, which arm is connected to a linkage 56. which linkage in turn is connected to a lug 58. The arrangement described enables the plunger 50 to be moved upward and downward in cylinder 48 in a true linear movement. A stuffing box 60 surrounds plunger in any desired position without the necessity of using set screws or the like. The arm 54 preferable is pointed at its outer end and is in register with a scale 62, which scale 62 is calibrated with a graduated indicia, that is, if the grade is in tenths of a foot, the scale 62 is graduated to read in tenths of a foot above zero and below zero. The conduit 44 extends to the bottom of a cylinder 64, which cylinder 64 has a plunger 66 therein, one end of which plunger has a piston or cup member 68 slidably mounted in cylinder 64. It is preferable to have a compression spring 70 within cylinder 64, so as to maintain piston 68 in contract relation with hydraulic fluid within cylinder 64. It is preferable to have the system filled with a non-compressible hydraulic fluid so that the pointed end of arm 54 rests on zero, when the cutting edge of the blade is just touching the surface of the terrain over which it is to be operated.

A conduit 45 has one end conncted to a tee 44*a*, which tee is connected with and is in fluid communication with conduit 44. A valve 45*a* is provided in conduit 45 intermediate tee 44*a* and hydraulic cylinders 72. The conduit 45 has a tee connection 45*b* which connects with a transverse conduit, as will best be seen in FIGS. 1 and 2, so that the fluid pressure, which is transmitted by a piston on plunger 76, will pass through pipe 45. when valve 45*a* is open into conduit 44 and into cylinder 64, to react on piston 68. Each cylinder 72 is pivotally connected, by means of a pin 78, to lugs 80 on frame 3 so as to maintain the plunger 76 of cylinder 72 in aligned relation therewith, upon the movement of lever 82 which is secured to a shaft 84, which shaft is journaled within bearing 88. An arm 90 is secured to shaft 84, which arm extends downward and has a caster wheel 92 thereon, which caster wheel will track in aligned relation with the track of wheel 8 of the traction element 2, and which caster wheel will pivot about an axis pin, so as to travel in the same direction as wheel 8.

A jydraulic safety compensator 96 is connected to conduit 45 by a tee 45*c*, which compensator has floating piston 98 therein, which piston is normally held at the lower-most position by a strong compression spring 100 that is positioned between the cap 102 and the top of the floating piston 98. The purpose of this compensator is to prevent the conduit 45 and the fittings thereon being bursted, by too much pressure, when the plunger 76 is actuated in cylinder 72 when valve 45*a* is closed. The compression strength of spring 100 is greater than the highest normal pressure which would be exerted on conduit 45 by the action of plunger 76 in cylinder 72. However, the spring is of less strength than is required to put a bursting pressure on conduit 45. Therefore, the presence of the compensator 96, within the system, will not affect the working of the system, but will provide a safety element so that the valve 45*a* may be manually closed when it is desired to operate the system without the automatic zero cylinders 72.

Figures 2, 5, 6:
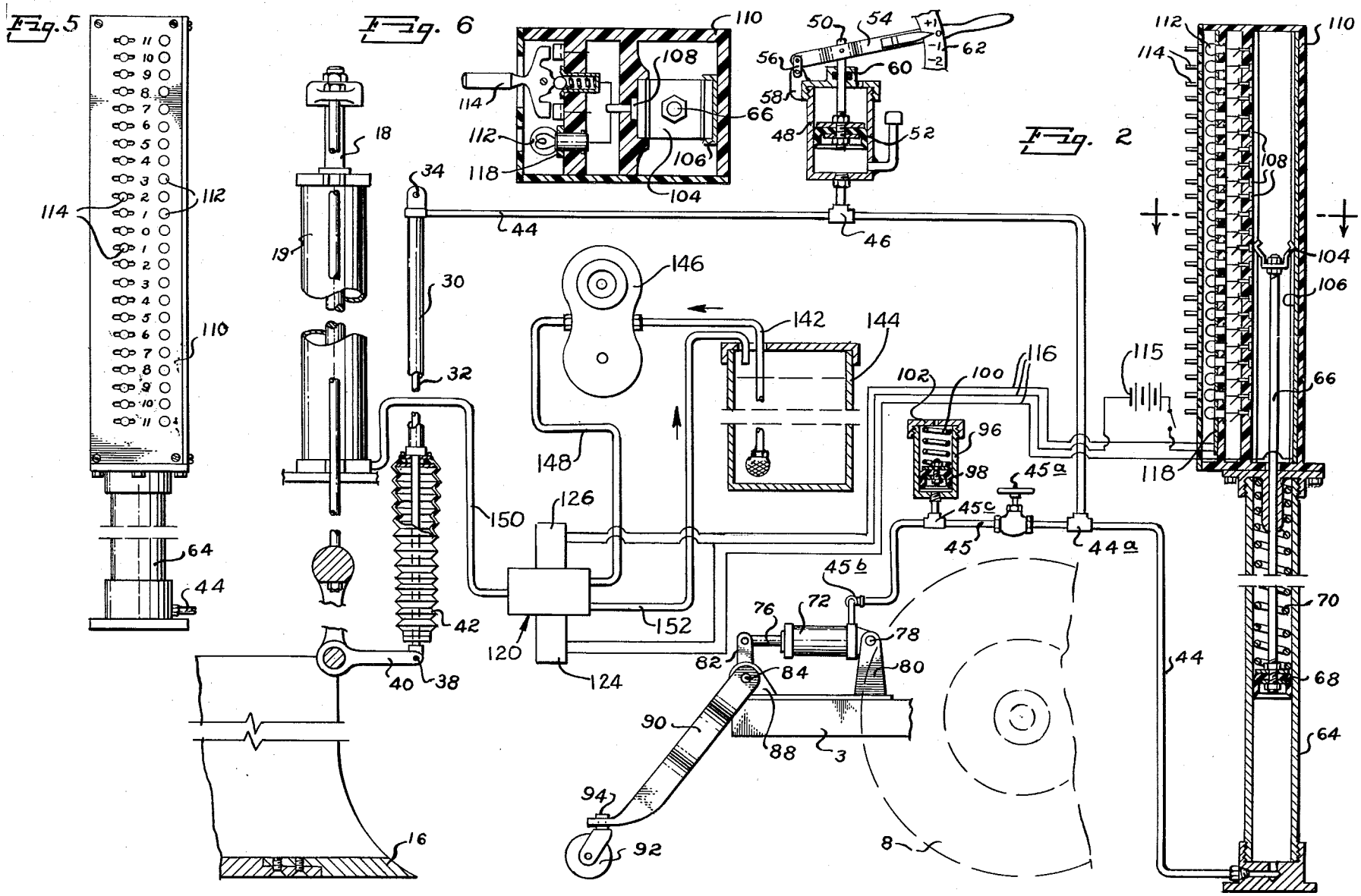
FIG. 2 is a schematic elevational view of the indicating and control system, showing the indicating control device connected to the earth moving machine, with parts being broken away and parts being shown in section to bring out the details of construction.
FIG. 5 is a front elevational view of the indicating panel, showing the switching arrangement, which arrangement enables the cutting edge of the blade to be maintained between specified limits, and showing a hydraulically actuated cylinder, with parts broken away and shortened.
FIG. 6 is a transverse sectional view taken on the line 6—6 of FIG. 2, looking in the direction indicated by the arrows.
Figure 5A:
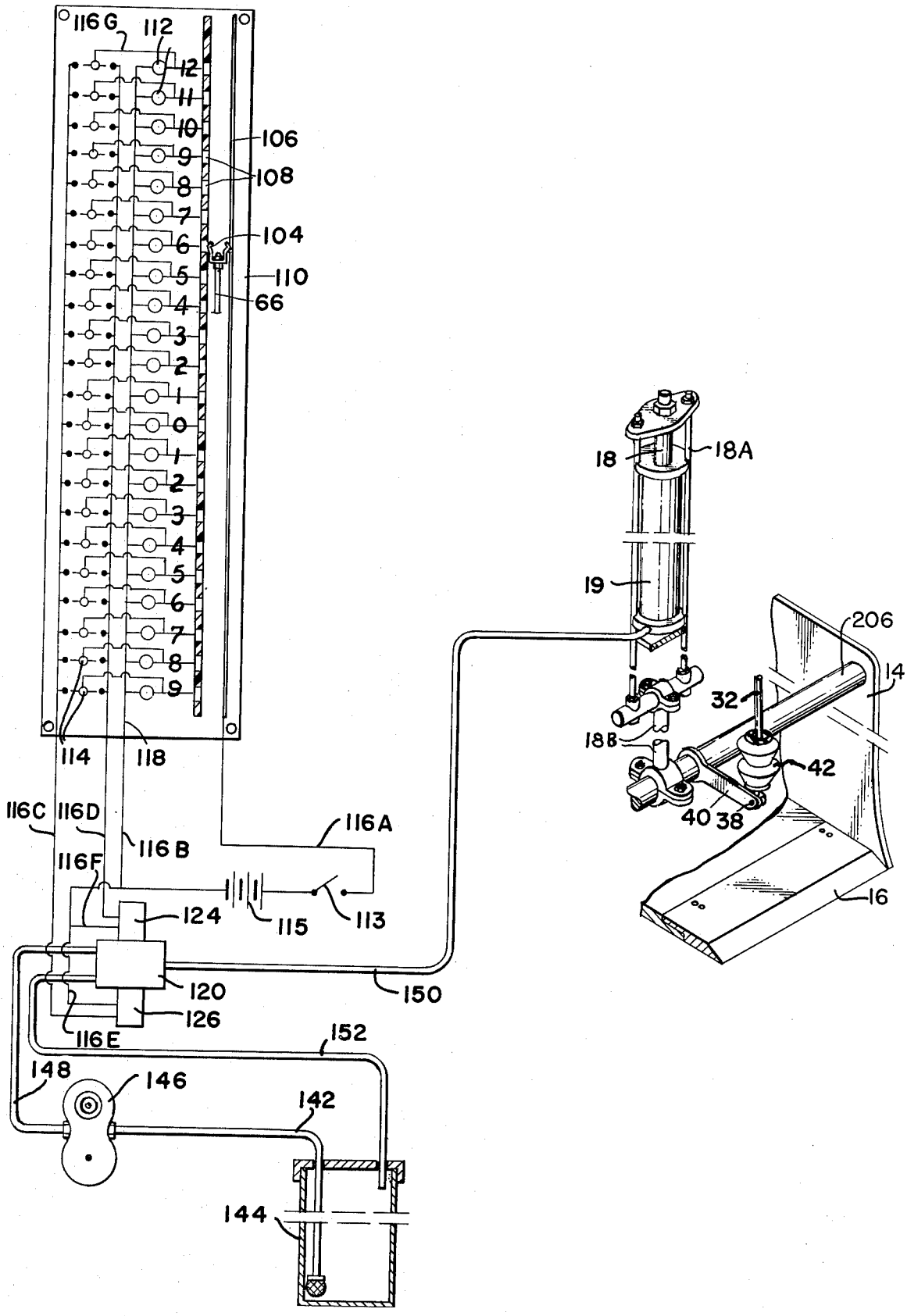
FIG. 5A is a diagrammatic view of the wiring and switching arrangement of the indicator and depth controller, similar to that shown in FIG. 10, and showing a portion of the scraper and hydraulic system in perspective.

The upper end of plunger 66 has the traveling contact brush element 104 thereon, one contact of which brush element is in contact with a common conductor 106, and the other contact of the traveling contact brush element 104 is adapted to contact spaced apart contact points 108, upon back and forth movement of the brust along the housing receiving unit, which is designated generally at 110. The contact points 108 are connected to indicator means, such as bulbs 112, by a conductor 116G, FIGS. 2, 5A and 6, and to the center connection of each of the switches 114, in the manner as shown in FIGS. 5A and 6.

Figure 9:
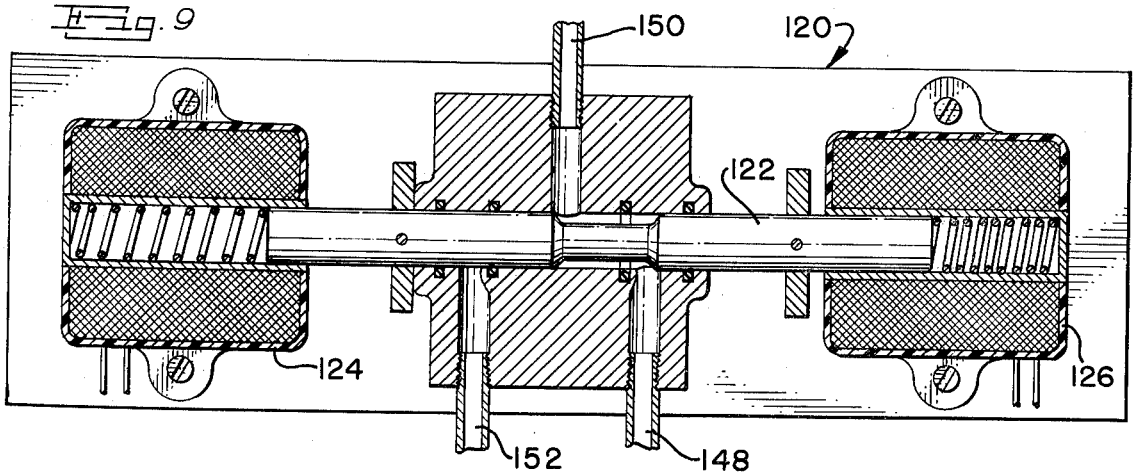
FIG. 9 is a view similar to FIG. 8, but with the hydraulic valve in the opposite extreme position.

A wire 116A is connected to one side of a battery 115 and the wires 116B and 116E are connected to the opposite side thereof. The wire 116B is connected to a common connector 118 on one side of the contact points 108 adjacent indicator bulb means 112, and with the wire 116A connected to the common conductor 106 and with switch 113 closed, electrical current will flow from battery 115 through switch 113 and through conductor wire 116A to common conductor 106 and through the brush 104 to one of the spaced apart contact points 108 and through conductor wire 116G to bulb 112 and back through common conductor 116B to the opposite side of the battery 115. The current will also flow therethrough and through conductor wire 116C to solenoid coil 126 of solenoid valve 120 and return through wire 116E to the opposite side of battery 115. This will cause the solenoid valve 120 to move to one position, such as to direct hydraulic fluid from reservoir 144 through suction pipe 142 into hydraulic pump 146 and out through discharge conduit 148, and with the hydraulic valve, in the position as shown in FIG. 9, hydraulic fluid under pressure will be directed into discharge line 150 into the lower end of hydraulic cylinder 19 to move the plunger 18 upward, which plunger is connected by linkage 18A and 18B to transverse bar 206 to raise the scraper blade 16 upward.

Figure 8:
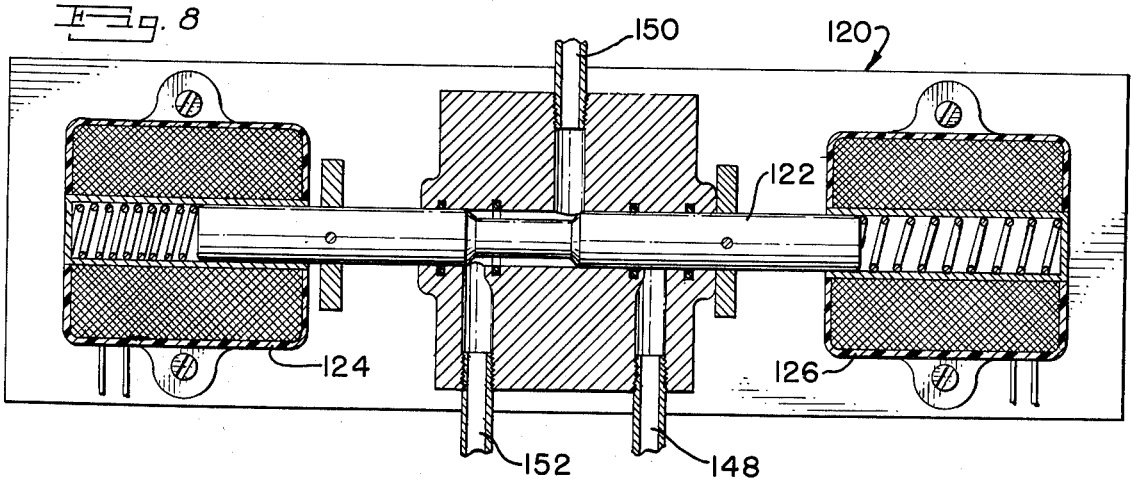
FIG. 8 is a view similar to FIG. 7, but with the valve shown in one extreme position.

Upon the scraper blade 16 moving upward, the plunger 32, which is pivotally connected at 38 to arm 40, will move upward, whereupon, the hydraulic fluid within cylinder 30 will transmit fluid to the lower end of cylinder 64 through pipe 44, whereupon, the brush 104 will move into contact with contact points 108, which will sequentially cause bulbs 112 to be illuminated at the position opposite the indicia, on the face of the indicator body 110, and, if a second switch 114 is moved to close contacts with conductor 116D, current will flow through solenoid coil 124 and through conductor wire 116F to conductor wire 116E to the other side of the battery 115, which will energize the solenoid 124 to move the spool valve 122 into the position, as shown in FIG. 8, which will permit the hydraulic fluid in cylinder 19 to be discharged through pipe 150, through solenoid valve 120 and through pipe 152 to return to reservoir 144.

Figure 7:
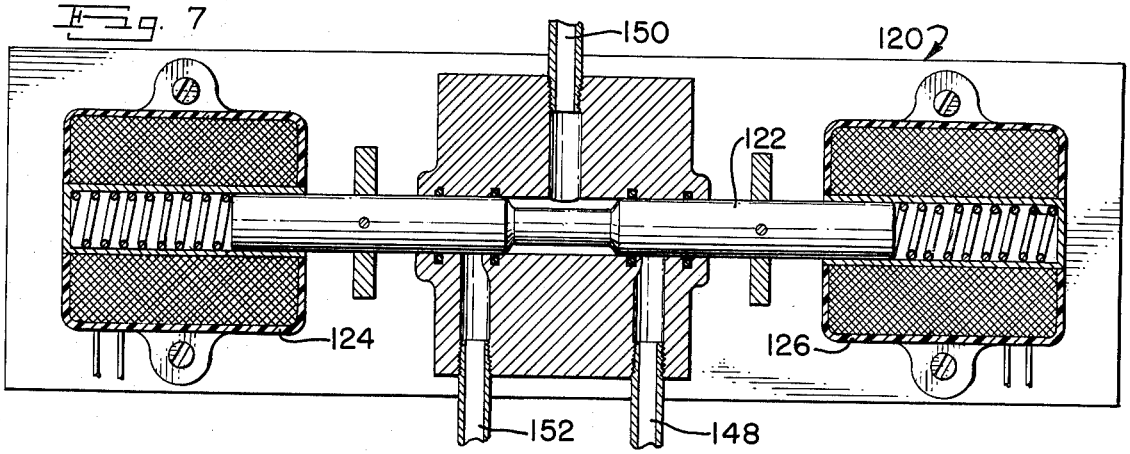
FIG. 7 is a longitudinal, sectional view through a three-way solenoid operated hydraulic control valve, the valve being shown in holding position.

When the plunger 18 in cylinder 19 moves downward, the plunger 32, in hydraulic cylinder 30 will move downward, which will cause hydraulic fluid in hydraulic cylinder 64 to move plunger 66, the brush 104 moves out of contact with the contact points 108, which causes the cessation of movement, as the current will cease to flow from battery 115, therefore the current to solenoid 124 will cease and the spool valve 122 will be moved into the position as shown in FIG. 7, by the springs therein. Upon the spool valve 122 being moved into this position, both the conduits 148 and 152 will be closed, which will prevent movement of plunger 18 in either direction.

The valve 120, as shown in the present instance, is a three-way, solenoid actuated valve, as cylinders which are used to raise earth moving scrapers will usually be single acting cylinders, as shown at 19, as the weight exerted downward on plunger 18 of the hydraulic cylinder 19, is sufficient to expell the hydraulic fluid from the hydraulic cylinder. However, in hydraulic cylinders using double acting plungers, a four-way valve of conventional construction can be used, instead of a three-way valve.

The plunger 122, which forms a spool valve in solenoid valve 120, is spring loaded, so upon de-energizing solenoids 124 and 126, the plunger will be moved into holding position, as shown in FIG. 7, without utilizing any current, and the edge of the blade 16 will be maintained in a fixed relation with respect to the setting of control switches 114.

If the terrain is such that the blade 16 needs to be raised, solenoid 126 is energized, which causes the spool valve plunger 122 therein to move to the position as shown in FIG. 9. By setting the limit switches 114 to energize solenoid 126 at the lowest point of travel and to energize solenoid 124 at the uppermost point of travel, the edge of cutting blade 16 may be held within predetermined limits, thereby taking control of the blade away from the operator, thus relieving the operator of the fatigue and tension incident to accurate control of the cutting edge of the blade, within predetermined limits.

By having each of the limit switches 114 of the double throw character, as shown in FIG. 6, the operator may quickly and selectively operate the blade at the desired depth of cut, which depth will be controlled within predetermined limit setting of switches 114. The switches 114 are held in predetermined position, FIG. 6, by a spring actuated plunger associated therewith, which is adapted to register with one of three notches within the switch to hold the switch in the desired set position, as will best be seen in FIG. 6.

SECOND FORM OF THE INVENTION

Figure 1:
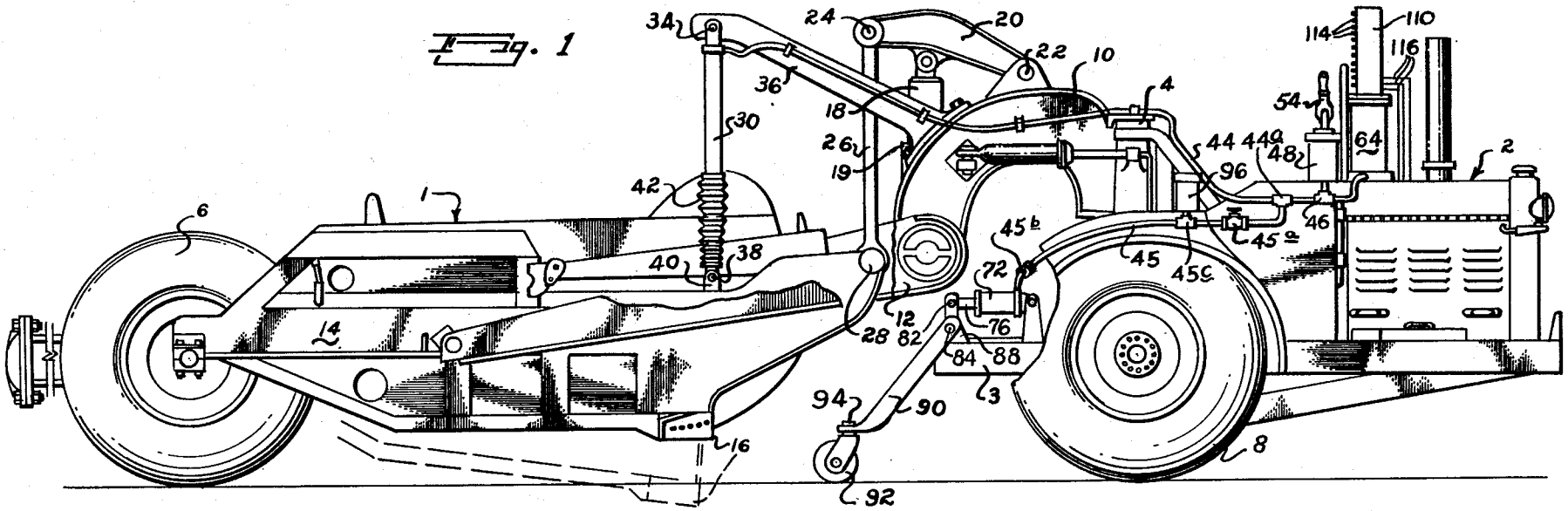
FIG. 1 is an elevational view of an earth moving device with a prime mover traction element connected thereto, and showing indicating and control devices mounted thereon, with parts being broken away and with parts being shown in dashed outline, to bring out the details of construction.
Figure 3:
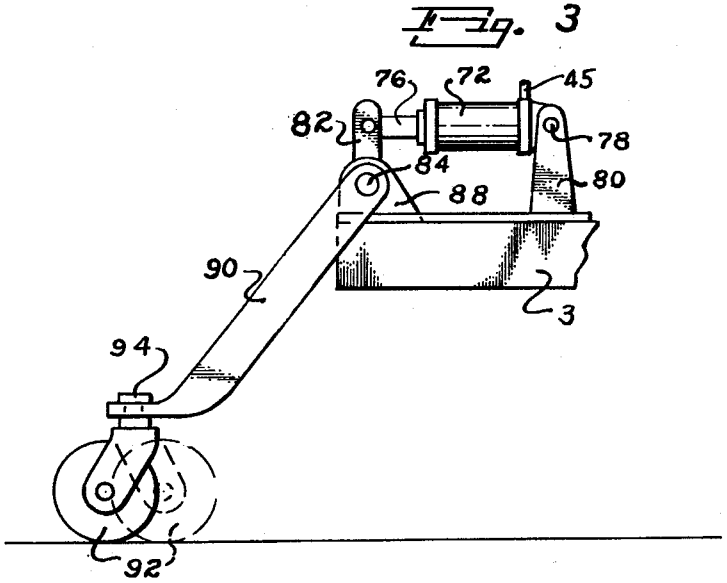
FIG. 3 is an enlarged, fragmentary, elevational view of an automatic zero compensating device, showing a ground engaging caster wheel thereon in full outline for the movement of the device in one direction, which wheel is shown in dashed outline for travel of the device in the opposite direction.
Figure 4:
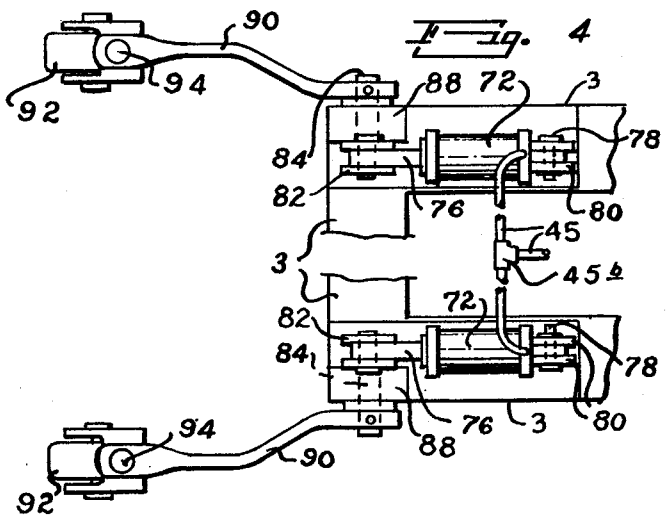
FIG. 4 is a top plan view of the caster wheels and associated mechanism, as shown in FIG. 3, showing the wheels adapted to follow in each of the tracks made by the wheels of the traction element.
Figure 11:
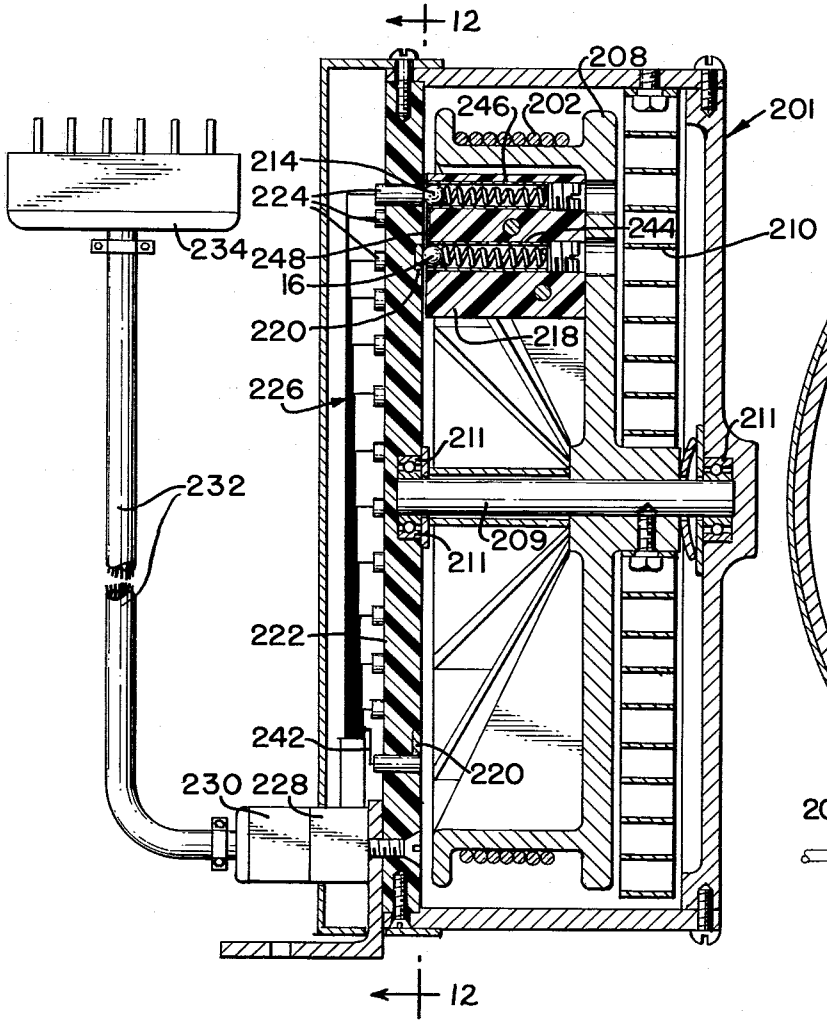
FIG. 11 is an enlarged sectional view through the contact element, showing the wiring leading therefrom.

The second form of the invention, as shown in FIGS. 10, 11 and 1w, is adapted to be mounted on an earth moving machine of the character shown in FIG. 1, so that the cable reeling drum 201 will be on the tractor element, and a cable 202 will be guided onto the drum by a suitable pulley 204, which cable is connected to a movable portion of the scraper body 14, such as to the bar 206. Upward and downward movement of the blade 16 will transmit linear motion through cable 202 to a reel 208, which reel has a spring 210 biased between the housing 212 and the reel 208, as will best be seen in FIG. 11. The reel 208 is rotatable with shaft 208, which shaft is journaled in bearings 211, so that the friction will be minimized during the recoiling of the cable 202 onto reel 208.

The reel 208 carries a brush-like member 214 and a brush-like member 216, which members are spring pressed, and which members are insulated from each other and from the reel 208 by insulation, indicated at 218. It is preferable to have these brush-like members of copper or stainless steel balls, which are in rolling relation with contact ring 220, which ring is mounted within an insulated member 222 within housing 212. A multiplicity of contact points 224 are circumferentially spaced around the axis of reel 208 and are adapted to be in register with the brush-like ball members 214 and 216, when the reel 208 is rotated. The electrical conductors 226 lead from the respective contact points to and through a multi-conductor receptacle 236 to pass current from battery 238 through switch 240, through a conductor 242, which is connected to the contact ring 220, and to pass current through the ball brush member 216, and since the casings 244 and 246 of the ball brush members 214 and 216 respectively are of conductor material and are connected together by a conductor 248, the current will then flow to ball 214 and therethrough to contact points 224, and through one of the conductors 226 through the receptacle 228 and plug 230, cable 232 and through the plug 234 and receptable 236, thence into one of the respective conductors 242 and thence through one of the indicator lights 252 through conductor 253 to return to battery 238 to complete a circuit to indicate the particular relation of the blade 16 of the earth moving machine with respect to the zero level at which the machine is operating.

The conductors 242 and 253 form a circuit which has branch circuits 254 in interconnected relation with respective switches 256 so as to enable one of the switches 256 to be moved into one position to direct current through conductor 258 to one of the solenoids 260 and through conductor 261 to complete a circuit to battery 238 to actuate solenoid valve 262. Another one of the switches 256 may be moved to close a circuit with conductor 264, and through conductor 267 to complete a circuit with conductor 264, which leads to solenoid 266 and through conductor 267 to complete a circuit to battery 238 to actuate solenoid valve 262, which is of the same construction as the solenoid valves shown in FIGS. 7 through 9. This will cause indicator lights 252 to light on the particular indicator level at which the blade 16 is operating.

However, if switches 256 are in position to close circuits 258 and 264 to the solenoids 260 and 266, the blade will move between the particular operating depth at which the switches 256 are set, in a manner as more fully set out in application, Ser. No. 337 972, now Patent 3 233 349 of William E. Becton, which application was co-pending with this application. Modifications of which are included in the present application and which applications are of common ownership. As the earth moving machine, such as indicated by the numberal 1 in FIG. 1, is moved over the terrain by the tractor element 2, as indicated in FIG. 1, the blade 16 may be set at the desired depth with respect to the zero level of the terrain and the blade may be maintained there either manually by observing the indicator lights 252 or by moving one switch 256 in one direction to close circuit 258 and moving another switch 256 in the opposite direction to close circuit 264, the solenoid valve will open and close to direct hydraulic fluid, under pressure, from pump 268, which will withdraw hydraulic fluid from reservoir 270 and withdraw the hydraulic fluid though conduit 272 and direct it out through conduit 274 into hydraulic valve 262. It is preferable that the pump 268 have a self-contained bypass and pressure relief valve therein so as to enable the pump to operate efficiently in directing fluid under pressure into conduit 276 and into an end of hydraulic cylinder 278 to actuate a piston 280 which is connected to scraper 14 to raise and lower scraper blade 16 in a manner well known in the art of hydraulic earth moving equipment. In this manner the scraper may be controlled either manually or automatically at the desired depth with respect to the terrain.

THIRD FORM OF THE INVENTION

The third form of the invention is disclosed in FIGS. 13 through 17, wherein a reel unit 301, which is similar in construction to the reel shown in FIG. 18, is mounted on a tractor element, such as designated at 1, and the cable 302 is guided over a pulley 304 in a manner similar to the second form of the invention, which cable is attached to the scraper body 14, which body has a blade 16 thereon so, upon movement of the scraper body, a cable 302 is moved in direct proportion to the movement of the cutting edge of blade 16, which movement is translated lineally through the cable onto the spring biased winding reel within cable winding unit 301, whereupon a flexible cable 306, which is mounted within housing 308, is attached to the rotatable axle member 310, so upon rotation of reel 310, within housing 301 by a cable 302, the lineal movement of cable 302 is translated into rotary movement to rotate drum 312 mounted within housing 314. The drum 312 is mounted on vertical shaft 316 which shaft is mounted on bearings 318.

Figures 13, 14, 15, 16:
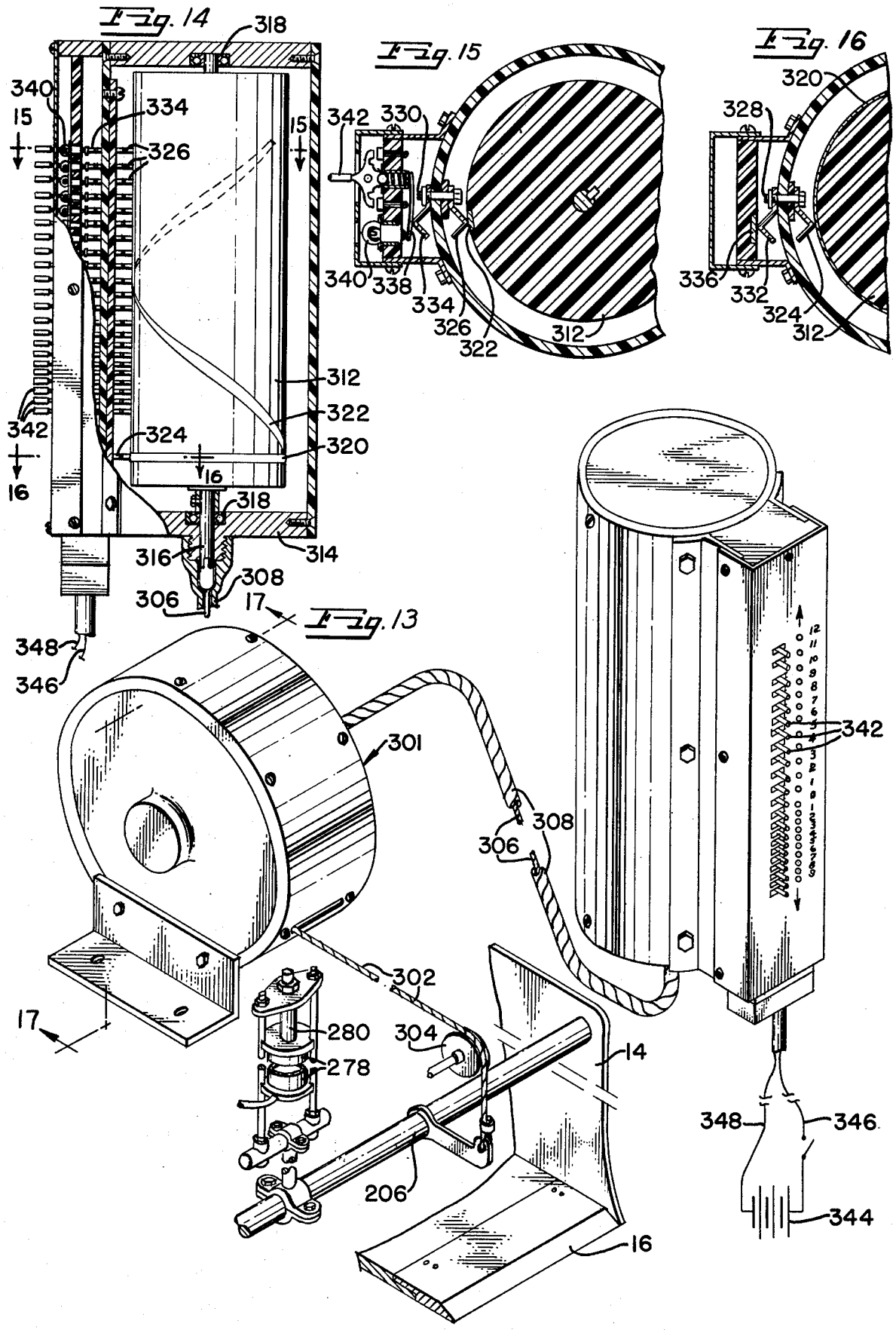
FIG. 13 is a perspective view of a third form in the invention, with parts broken away and shortened to bring out the details of construction.
FIG. 14 is a longitudinal, sectional view through the indicating and switch control mechanism, with parts broken away, and with parts shown in elevation to bring out the details of construction.
FIG. 15 is a sectional view, on an enlarged scale, taken on the line 15—15 of FIG. 14, looking in the direction indicated by the arrows.
FIG. 16 is a sectional view taken on the line 16—16 of FIG. 14, looking in the direction indicated by the arrows.

An annular ring 320, which is of electrical conductor material, is mounted on drum 312, which drum is made of insulated material or which is so insulated that the electrical current on ring 320 will not pass onto spiral conductor strip 322 except through brushes 324 and 326, as will best be seen in FIGS. 14 through 16. The present unit is comparatively free of handwired connections, as the brushes 324 and 326 are held in place by conductor belts 328 and 330, which bolts also hold resilient clips 332 and 334, respectively, which clips serve as conductors to conduct electrical current to xonsuxroea 336 and 338, respectively. In this manner the indicator lights 340 and switches 342 are in contact with respective conductors to transmit electrical energy therethrough upon the rotation of the spiral conductor strip 322 contacting a particular brush 326, whereupon the light indicating system and switches are of the same character as in the aforementioned application of William E. Becton.

With this form of the invention the only electrical wires are from opposite terminals of a battery 344, which battery terminals have conductors 346 and 348 leading therefrom to connect with respective conductor 336 and the respective indicator light circuit and switch circuit within the housing 314 as shown in FIG. 10.

FOURTH FORM OF THE INVENTION

A fourth form of the invention is shown in FIGS. 18 and 19, which form of the invention is for the purpose of indicating the relative position of blade 16 relative to the surface of the terrain of an earth moving machine 1 when moved over the terrain. This form of the invention utilizes a reel unit 301 having a reel 310 journaled therein and secured to a shaft 309. A spring 311 is biased between the housing 301 of the reel unit and the reel 310 to wind a cable 302 thereonto, as will best be seen in FIG. 17. The cable 302 extends outward over pulley 304 and is connected in operable relation with a portion of the movable scraper body 14, as will best be seen in FIG. 18. The reel 310 is of such size as to transmit rotary movement through shaft 309 and through a flexible cable 306 in a housing 308, to a shaft 410 within indicator housing 401 wherein bevel gears 412 are mounted, which bevel gears are of such ratio as to rotate shaft 414 to move indicator hand 402 relative to indicia 404, 406 and 408, with an indicia 404 being the zero or ground level marking and with the indicia 406 being above ground level and the indicia 408 being below ground level. The housing 401 is closed within a transparent cover 418 to enable visual indication of the operations of the earth moving machine by the operator to determine the relative position of the cutting edge of blade 16 to the surface of the terrain.

The indicator 401 may be mounted in a suitable location so as to be viewed by the driver during the operation of the earth moving machine.

FIFTH FORM OF INVENTION

A fifth form of the invention is shown in FIGS. 20, 21, 22, 23 and 24, wherein a reel winding unit, designated generally at 501, such as shown in FIG. 20, is journaled within a housing in a manner similar to the reel shown in FIG. 17, one of the aforementioned forms of the invention. The reel within the winding unit 501 is spring loaded and is operable in same manner as the form of the invention as shown in FIG. 17. The spring is biased between the reel and the housing, so as to reel in the cable 502, when the blade is raised. The cable 502 is connected to a movable portion of a blade member 16 of the earth moving machine. The cable 502 passes over a pulley 504 and wherein an electrical magnetic inductance device, such as a unit of a selsyn generator, is connected by shaft 507 to the reel within housing 501. As the armature in selsyn generator unit 506 is rotated, electro-magnetic impulses are produced, which are transmitted to selsyn motor 508, through conductors 510, with the incoming current being impressed on the selsyn generator and the selsyn motor by circuit 512.

The selsyn motor 508 has a shaft 514 on which is mounted an arm 516, on which arm a brush 518 is mounted to pick up current from contact points 520 and to pass the current through conductor wires leading from contact points 520 onto cable 232 to a depth control unit, such as shown diagrammatically in FIG. 10, with the wires 530 connecting to opposite sides of a battery, such as battery 238, to form a depth control unit, for use in the same manner as described for the second form of the invention, which description, for the sake of brevity, will not be repeated.

An electric light bulb 522 is mounted on arm 516, which light bulb burns continuously to illuminate through holes 524 to indicate the position of blade 16 below or above the terrain. The holes 524 are arranged in a circular pattern, so that the light will emanate therethrough. However, exterior of a dial 526, within which holes 524 are formed, is an indicator, such as an arrow 528. In this manner the light passing through the holes will enable the reading of the indications by day.

A circuit 530 leads from a source of electrical supply to the slip rings 532 and 534.

SIXTH FORM OF INVENTION

A modified form of receiving unit for the fifth form of the invention, is shown in FIGS. 23 and 24, wherein, the cable 510 connects the selsyn generator 506 with the selsyn motor 508, substantially in the same manner as shown for the fifth form of the invention, and wherein, the reel winding unit 501, as well as the cable 502, which connects with transverse bar 206, to sense the raising and lowering of earth engaging blade 16, is the same as for the aforementioned form of the invention. However, instead of cable 232 extending to a separate control unit for switching and automatic control of the position of the blade 16, the dial or face of the unit has switches 526 arranged circumferentially around the face thereof, one switch for every indicia on the dial, with the circuitry being similar to that of the second form of the invention, and being arranged in a circular pattern so, upon brush 518 contacting one of the contact points 520, current will flow through wire 254 which leads to the center connection of switch 256, which is a double throw switch, as shown in FIG. 6, which will enable the switches 256 to be moved in one direction to close a circuit from 530B through wire 258, which connects switch contacts on one side of each of the switches 256, which will direct current through solenoid coil 260 and out through wire 261 to the other side of battery 238 to direct fluid through a solenoid valve 262 to the cylinder 278 in one direction, or, upon moving switch 256 to the opposite position, the current will flow from brush 518 through switch 256 into circuit 264 to solenoid coil 256 to shift the solenoid valve therein to direct hydraulic fluid in the opposite direction therethrough, as is more fully set out in the second form of the invention, described above, and, for the sake of brevity, will not be repeated, however, the corresponding parts are numbered with corresponding numerals, in so far as applicable.

What is claimed is:

1. An attachment for an earth moving machine having a ground engaging blade and a hydraulic system for raising and lowering the ground engaging blade, which attachment comprises:

(a) a first electrical circuit, (b) a first selsyn motor mounted on the earth moving machine and being connected within said first electrical circuit, which selsyn motor is capable of receiving electro-magnetic impulses, (c) a selsyn generator connected with said first electrical circuit, which selsyn generator is capable of generating electro-magnetic impulses to be transmitted to a receiving motor for synchronous rotation therewith, (d) an indicator means connected with the shaft of said first selsyn motor, (1) a dial surrounding said shaft and being readable with respect to said indicator means, (2) circumferentially spaced indicia on said dial of said indicator means to indicate the relative position of said first selsyn motor with respect to said selsyn generator to indicate the position of the ground engaging blade with respect to the surface of the terrain, (e) an electrical circuit associated with said indicator means, (f) a bulb mounted on said indicator means and being connected within said electrical circuit, (g) said dial having circumferentially spaced holes formed therein adjacent said indicia, (h) said bulb on said indicator means being adapted to swing arcuately in register with the holes formed in said dial, (i) an electrical circuit associated with said indicator means, (j) said indicator means having an electrical brush mounted thereon and connected with said electrical circuit, (k) circumferentially spaced contact points on said dial, which points are adapted to register with said brush on said indicator means when moved arcuately, (l) circuits leading from each said contact points, (m) a double throw limit switch associated with each of said circuits leading from said contact points, (n) an electrically controlled valve associated with the hydraulic system to control the flow of hydraulic fluid therein to move the ground engaging blade with respect to the surface of the terrain, (o) said electrically controlled valve having two circuits leading thereto for movement of the valve to different positions, (p) a switch contact on opposite sides of each said double throw limit switch, (q) a circuit leading from each contact on one side of each said limit switch to said electrically controlled valve, (r) a second set of electrical contacts leading from the other of said contacts of said double throw limit switches, which contacts lead to another circuit associated with said electrically controlled valve so as to move the valve in the opposite direction from the movement accorded by the first mentioned circuit, (1) a source of electricity, (2) the other side of each circuit leading from said electrically controlled valve being connected with said source of electricity, and (s) said limit switches actuating said electrically controlled valve to admit fluid therethrough in one direction or to direct fluid therethrough in the opposite direction, in accordance with the setting of said limit switches, to maintain the ground engaging blade within certain limits with respect to the terrain.

* * * * *